US010923243B2

(12) United States Patent
Koehler et al.

(10) Patent No.: US 10,923,243 B2
(45) Date of Patent: Feb. 16, 2021

(54) GRATING STRUCTURE FOR X-RAY IMAGING

(71) Applicant: KONINKLIJKE PHILIPS N.V., Eindhoven (NL)

(72) Inventors: Thomas Koehler, Norderstedt (DE); Gereon Vogtmeier, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/469,310

(22) PCT Filed: Dec. 12, 2017

(86) PCT No.: PCT/EP2017/082305
§ 371 (c)(1),
(2) Date: Jun. 13, 2019

(87) PCT Pub. No.: WO2018/108853
PCT Pub. Date: Jun. 21, 2018

(65) Prior Publication Data

US 2019/0355488 A1 Nov. 21, 2019

(30) Foreign Application Priority Data

Dec. 15, 2016 (EP) ..... 16204258

(51) Int. Cl.
*G21K 1/06* (2006.01)

(52) U.S. Cl.
CPC ..... *G21K 1/067* (2013.01); *G21K 2207/005* (2013.01)

(58) Field of Classification Search
None
See application file for complete search history.

(56) References Cited

U.S. PATENT DOCUMENTS 5,099,134 A 3/1992 Hase
7,638,732 B1 12/2009 Dobbs
(Continued)

FOREIGN PATENT DOCUMENTS

JP 2012247536 A 12/2012
WO WO2012055495 A1 5/2012

OTHER PUBLICATIONS

PCT International Search Report, International application No. PCT/EP2017/082305, dated Apr. 4, 2018.

*Primary Examiner* — Hoon K Song
(74) *Attorney, Agent, or Firm* — Larry Liberchuk

(57) ABSTRACT

The present invention relates to a grating in X-ray imaging. In order to provide a grating with a facilitated stabilization, a grating (10) for X-ray imaging is provided that comprises a grating structure (12) with a first plurality of bar members (14) and a second plurality of gaps (16). A fixation structure (18) is arranged between the bar members to stabilize the grating bar members. The bar members are extending in a length direction (20) and in a height direction (22). The bar members are also spaced from each other by one of the gaps in a direction transverse to the height direction. The gaps are arranged in a gap direction parallel to the length direction. The fixation structure comprises a plurality of bridging web members (24) that are provided between adjacent bar members. Further, the web members are longitudinal web members that are extending in the gap direction and that are provided in an inclined manner in relation to the height direction. The inclination is provided in the gap direction.

15 Claims, 3 Drawing Sheets

(56) References Cited

U.S. PATENT DOCUMENTS

| | | | | |
|---|---|---|---|---|
| 2007/0183579 | A1 | 8/2007 | Baumann | |
| 2011/0248174 | A1 | 10/2011 | O'Connor | |
| 2012/0201349 | A1* | 8/2012 | Kaneko | A61B 6/4291 378/62 |
| 2012/0307976 | A1 | 12/2012 | Kaneko | |
| 2014/0177781 | A1* | 6/2014 | Singh | G21K 1/02 378/4 |
| 2015/0055744 | A1 | 2/2015 | Anton | |

* cited by examiner

GRATING STRUCTURE FOR X-RAY IMAGING

FIELD OF THE INVENTION

The present invention relates to a grating for X-ray imaging, to an X-ray imaging system and to a method for manufacturing a grating for X-ray imaging.

BACKGROUND OF THE INVENTION

In X-ray imaging, gratings are used, for example for differential phase contrast imaging or dark-field imaging. The gratings provide a repeated pattern of alternating areas, e.g. strips, of X-ray attenuating material and areas less X-ray attenuating. Another use of X-ray gratings are anti-scatter grids. In relation with higher image quality, a demand for large aspect ratios exists. A grating with a large aspect ratio and thin wall segments may have weakened mechanical stability and needs additional fixation. For example, WO 2012 055495 A1 describes a resist structure for producing an X-ray optical grating structure.

SUMMARY OF THE INVENTION

There may thus be a need to provide a grating with a facilitated stabilization.

The object of the present invention is solved by the subject-matter of the independent claims; further embodiments are incorporated in the dependent claims. It should be noted that the following described aspects of the invention apply also for the grating for X-ray imaging, for the X-ray imaging system and for the method for manufacturing a grating for X-ray imaging.

According to the present invention, a grating for X-ray imaging is provided. The grating comprises a grating structure with a first plurality of bar members and a second plurality of gaps. The grating further comprises a fixation structure that is arranged between the bar members to stabilize the grating bar members. The bar members are extending in a length direction and in a height direction. Further, the bar members are spaced from each other by one of the gaps in a direction transverse to the height direction. The gaps are arranged in a gap direction parallel to the length direction. The fixation structure comprises a plurality of bridging web members that are provided between adjacent bar members. The web members are longitudinal web members that are extending in the gap direction and that are provided in an inclined manner in relation to the height direction. An inclination is provided in the gap direction.

The inclined arrangement of the web members provides less artifact for the X-ray detector, i.e. the inclined web members have less affect, since the inclination takes place within the gap and in the gap's direction. The inclined arrangement also results in a facilitated manufacturing.

The fixation structure comprises the plurality of bridging web members that are arranged in the gaps and that are provided between adjacent bar members.

In an example, the bar members provide first grating members and the gaps provide second grating members. The web members provide bridging members that connect adjacent first grating members, wherein the bridging members protrude through, i.e. extend or span across, the second grating members, i.e. the bridging members cross the second grating members. The second grating members, i.e. the gaps, thus comprise space between the bar members that is arranged for providing a respective gap (or imaging) function (i.e. for providing an area or space with a different X-ray attenuation or absorption characteristic than the bar members). The second grating members, i.e. the gaps, also comprise space, in which the web members are located, that is arranged for providing a respective stabilizing (or mechanical) function.

The bridging members thus each occupy a part of the gap, they each take away a small portion of the gap.

The second grating members, i.e. the gaps, thus comprise the bridging members and a resulting net gap space. The space occupied by the bridging members can also be referred to as bridging or connection space.

The first plurality of the bar members is thus interconnected by the web members bridging the second plurality of the gaps.

The web members provide stabilizing elements for the bar members.

According to an example, the web members and the bar members are made from the same material.

In an option, the web members and the bar members are made as a one-piece structure.

The term "same material" relates primarily to the X-ray attenuation properties of the material. In an option, the exact same material is used. In an alternative option, different materials are used, but with essentially equal X-ray attenuation properties.

In an example, the web members and the bar members are made as one piece, e.g. by a common manufacturing process.

The gap space, i.e. the resulting net gap space comprises a different material, i.e. different compared to the material of the bar members and the bridging members. The material of the gap space is at least different in terms of X-ray attenuation properties.

According to an example, the bar members and the web members are made from structural material and an X-ray absorbing material is arranged in the gaps. The structural material is less X-ray absorbing than the X-ray absorption material.

The first plurality of the bar members and the web members thus provide a constructive structural arrangement of the grating structure, i.e. a constructive or supportive structure of the grating structure. The second plurality of the gaps provides the X-ray absorbing arrangement of the grating structure, i.e. an X-ray absorptive or X-ray blocking structure of the grating structure.

The "absorbing material" relates to a material that absorbs a major part of the X-ray radiation. For example, in view of X-ray imaging only a neglectable amount of X-ray is not absorbed. For example, the absorbing material comprises lead and/or gold. The absorbing material is provided in the resulting net gap space. The gaps thus comprise primary portions with the absorbing material and secondary (smaller) portions with the structural material of the web members.

Thus, the X-ray absorbing material is arranged in a part of the gaps, when considering the gaps as the area between the bar members. When the term "gaps" is used for the resulting net gap space, i.e. the space between the bar members subtracted by the space occupied by the web members, the X-ray absorbing material is arranged in the gaps. In an example, the gaps (if understood as net gap space) are completely filled with the X-ray absorbing material. In another example, the gaps (if, again, understood as net gap space) are partly filled with the X-ray absorbing material. The other part can be filled with further material or can also be left empty.

The "structural material" relates to a material that is capable of providing sufficient rigidity for the grating at least for the purpose of handling during manufacturing and assembling the grating. For example, the structural material comprises silicon or other suitable material for a grating in X-ray imaging. In an example, the structural material is configured to provide structural, i.e. mechanical stability of the grating. The structural material provides at least such stability that the absorbing material is fixedly attached and supported by the bar members and/or the web members.

In an example, the bar members and the web members are made from the same material. In another example, two different materials are used for the bar members and the web members.

According to an example, the grating is an absorber grating and the grating structure is made such that the gaps are filled with the X-ray absorbing material for X-ray absorption by the gaps. The bar members are provided to be less X-ray absorbing for X-ray radiation transmission in the bar members.

The X-ray absorbing material in the gaps is more X-ray absorbent than the web members.

The web members are provided along the gaps as a diagonal structure in relation to an X-ray viewing direction. The diagonal structure interrupts the absorbing structure along the gaps.

Since the web members, in X-ray viewing direction only form a small part of the space of the gap, as a result, the gaps will always be more X-ray absorbent than the bar members.

According to an example, the grating is an absorber grating and the grating structure is made such that the gaps are filled with the X-ray absorbing material for X-ray absorption by the gaps. The bar members are provided to be less X-ray absorbing for X-ray radiation transmission in the bar members, i.e. less absorbing for transmission of X-ray in the bar members.

According to an alternative example, the grating is an absorber grating and the grating structure is made such that the bar members are made from X-ray absorbing material for X-ray absorption by the bar members. The gaps are provided to be less absorbing for X-ray radiation transmission in the gaps, i.e. for transmission of X-ray in the gaps.

As an option, the gap part is less X-ray absorbent than the web segment part.

The space of the gaps is less X-ray absorbent than the web members reaching through the gaps. The web members can be provided by X-ray absorbing material, e.g. the same material as used for the bar members. Since the web members, in X-ray viewing direction only form a small part of the space of the gap, as a result, the gaps will always be less X-ray absorbent than the bar members.

The gaps may be provided with an X-ray transparent filler or may also be provided non-filled. Since the web members are provided in an inclined manner, the X-ray signal is improved due to more distributed attenuation by the web members in relation to the X-ray radiation direction.

According to an example, the web members are arranged between the adjacent bar members such that the web members are connecting opposing portions of the bar members.

According to another example, in a non-assembled state the web members are arranged parallel to each other.

The grating may be configured to be bent for focusing during assembly. For example, the grating may be configured to be applied to a curved support structure or curved mounting surface.

In an option, in a non-assembled state the web members are arranged in relation to a radiation direction of a fan-shaped X-ray beam; the web members are arranged with the same inclination angle to the radiation direction.

Non-assembled state refers to a state where the grating is not mounted its final position within an X-ray imaging system.

According to an example, in an X-ray radiation viewing direction, across the height at least one first gap part and at least one web segment part are provided.

In an example, in a non-mounted state the grating is provided as a planar grating and in a direction transverse to the planar plane of the grating, e.g. normal or perpendicular to the plane, in a gap, across the height, at least one gap part is provided and at least one web segment part.

According to an example, the web members are arranged such that, in an X-ray radiation viewing direction, a continuous degree of X-ray attenuation is provided along the gaps.

This further improves the X-ray detector's signal and reduces the effort for post-processing of the signal.

When the X-ray absorption is provided by the gaps, a continuous degree of rather high absorption is provided along the gaps. This high absorption is provided by the X-ray absorbing material arranged in the gaps, which material is provided in addition to the web members that are also arranged in the gaps but which themselves do provide a rather low attenuation (i.e. no or nearly X-ray absorption). Further, also a continuous degree of a rather or very low attenuation (for example X-ray transparent, i.e. with a neglectable X-ray attenuation in view of X-ray imaging) is provided along the bar members.

When the X-ray absorption is provided by the bar members, a continuous degree of rather high absorption is provided along the bar members. This high absorption is provided by the X-ray absorbing material of the bar members. Further, also a continuous degree of a rather or very low attenuation (for example nearly X-ray transparent, i.e. with a neglectable X-ray attenuation in view of X-ray imaging) is provided along the gaps, members. Although the web members are also arranged in the gaps and the gaps themselves may provide X-ray attenuation due to a material providing X-ray absorption, but due to their small contribution in X-ray radiation direction, as a result they provide a rather low attenuation.

According to an example, the web members are extending in a continuous manner from an upper edge of the bar members to a lower edge of the bar members.

According to another example, the web members are arranged repeatedly in gap direction with a distance D over a gap height H. The web members have an inclination ratio in relation to the height direction R of D/H.

According to an example, the web members are arranged at least as one of the following:

i) as repeatedly arranged inclined web members with the same inclination angle;

ii) as inclined segments with the same inclination angle value, but with alternating inclination directions, which results in a zig-zag web pattern along the gap; and iii) as repeatedly arranged inclined web segment portions that are provided in a crossing manner, which results in an X-type repeated web pattern.

According to an example, the grating is an absorber grating for phase contrast and/or dark-field X-ray imaging.

According to another example, the grating is an anti-scatter grid for X-ray imaging.

According to the present invention, also an X-ray imaging system is provided. The X-ray imaging system comprises an X-ray source and an X-ray detector and a grating according to one of the above examples to be arranged in an X-ray radiation path between the X-ray source and the X-ray detector.

According to an example, the X-ray source provides the X-ray radiation towards the X-ray detector in an X-ray viewing direction. The web members are provided in an inclined manner in relation to the X-ray viewing direction.

The term "X-ray radiation" relates to X-ray radiation generated by the X-ray source that radiates towards the X-ray detector. The term "X-ray radiation path" relates to the propagation of the X-ray radiation. The X-ray radiation path thus describes the spatial area in which radiation is provided. For X-ray imaging, an object has to be arranged along the path to be able to generate X-ray image data. The X-ray radiation path can also be referred to as "X-ray radiation beam path".

In an example, the X-ray radiation is provided as a cone- or fan-shaped X-ray beam. The X-ray radiation thus provides a plurality of respectively arranged viewing directions.

In another example, the X-ray radiation radiating the object is provided as coherent X-ray radiation with an essentially parallel arranged X-ray radiation. In an example, the X-ray source provides the coherent radiation. In another example, the X-ray source provides non-coherent radiation, which is then subject to a (source) grating structure to provide the coherent radiation.

The term "X-ray viewing direction" relates to the direction of the X-ray radiation from the X-ray source to the X-ray detector. In case of a cone- or fan-shaped beam, the X-ray viewing directions vary respectively across the beam. In case of coherent, i.e. parallel X-ray radiation, the X-ray viewing directions across the beam are parallel to each other.

In an example, the grating is provided as a flat grating where the web members are parallel to each other. When assembling the grating in an X-ray imaging system with a fan- or con-shaped beam, the grating is focused during assembly of the imaging system. For example, the grating is applied to a respectively shaped surface to bent when applying the grating to the shaped surface. In an example, the surface is curved, such as having a shape from a part of a concave spherical surface.

According to an example, a grating arrangement for phase contrast and/or dark-field X-ray imaging is provided with the X-ray imaging system. At least partially coherent X-ray radiation is provided to irradiate an object. The grating arrangement comprises at least a phase grating and an analyzer grating. The grating is provided as an absorption grating forming the analyzer grating and/or a source grating to provide the at least partially coherent X-ray radiation.

That is, the analyzer grating and/or a source grating, to provide the at least partially coherent X-ray radiation, is/are provided as an absorption grating, which is provided as a grating according to one of the examples above.

According to the present invention, also a method for manufacturing a grating for X-ray imaging is provided. The method comprises the following steps:

a) Generating a grating structure with a first plurality of bar members and a second plurality of gaps. The bar members are extending in a length direction and in a height direction, and are spaced from each other by one of the gaps in a direction transverse to the height direction.

b) Generating a fixation structure arranged between the bar members to stabilize the grating bar members. The fixation structure comprises a plurality of bridging web members that are provided between adjacent bar members. The web members are longitudinal web members that are extending in the direction of the gaps and that are provided in an inclined manner in relation to the height direction.

Grating-based phase-contrast and dark-field imaging is a promising technology to enhance the diagnostic quality of X-ray equipment e.g. in the areas of mammography, chest-radiography, and CT. According to an aspect, a solution is provided for a grating for a clinical system for grating-based phase-contrast and dark-field imaging. For example, an absorption grating G0 ("source grating") or an absorption grating G2 ("analyzer grating") is provided with a grating structure, for example in gold, with pitches in the order of a few μm to a few 10 μm, at heights of more than 200 μm, in order to achieve sufficient attenuation across the entire spectrum of the X-ray tube. For example, the so-called LIGA process is used for manufacturing such gratings. Due to the instruction of stabilizing structures, the gratings are stabilized and adhesion forces do not affect the geometrical precision of the grating. By providing inclined web members, for example as inclined bridges, the artifacts—registered by the sensor—caused by the fixation elements structure are decreased. When providing an even X-ray attenuation, an improved signal quality is achieved. As a further result of an example with continuous web members, only one mask is required in the manufacturing process. Additional undesired fringe pattern or additional noise are avoided or at least reduced.

In an example, during a lithographic step, a mask with a bridge design is tilted around an axis perpendicular to the desired grating direction. This leads to tilted bridges or web members as mentioned above. The additional attenuation due to the bridges is distributed much more evenly across the grating area, which reduces the impact on image quality. In an example, for a given grating height H and a distance d between the web members along a trench, there is a dedicated tilt angle such that a homogeneous grating structure is achieved in transmission perpendicular to the grating area. In an example, this tilt angle $\alpha$ fulfils the relation $\tan \alpha = d/H$. At the same time, only a single illumination step is needed during lithography. The maximum length of the tilted bridge structure is correlated with the maximum achievable depth of the lithography process. The tilting angle has to be selected according to the lithography limitation as well as to the capability to electroplate the gold (or other material) under the bridge structure within the open volume of the parallelogram.

Differential phase contrast imaging and dark-field imaging rely on the use of X-ray optical gratings. According to an aspect, to mechanically stabilize the grating structure, web members, for example as a bridge structure, are provided. The structure minimizes inhomogeneity without increasing lithography complexity for manufacturing. It is provided to rotate a web segment around an axis of rotation that is square to the grating direction. By doing so, a homogeneous grating can be obtained without increasing lithography complexity.

Instead of tilting in the direction of $\alpha$ or $-\alpha$, it is also possible to make double illumination steps and allow for example for V-shaped and W-shaped structures as well as X-shaped structures with a homogeneous distributed absorption of the stabilizing structure along the complete groove. In an example, the grating comprises multiple rotated web members to obtain an X-, V-, or XXX- or VVV- or combined X-V-pattern (when seen along the grating direction).

In an example, the X-, XV- or VV-pattern is provided with a displacement such that a gap exists to be able to fill the lower part e.g. with X-ray absorbing material. For example, a distance is provided to achieve a V_V pattern; or a vertical displacement of the upper ends is provided such that a gap exists along a vertical direction.

The filling may be provided, in an example, by electroplating.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1:
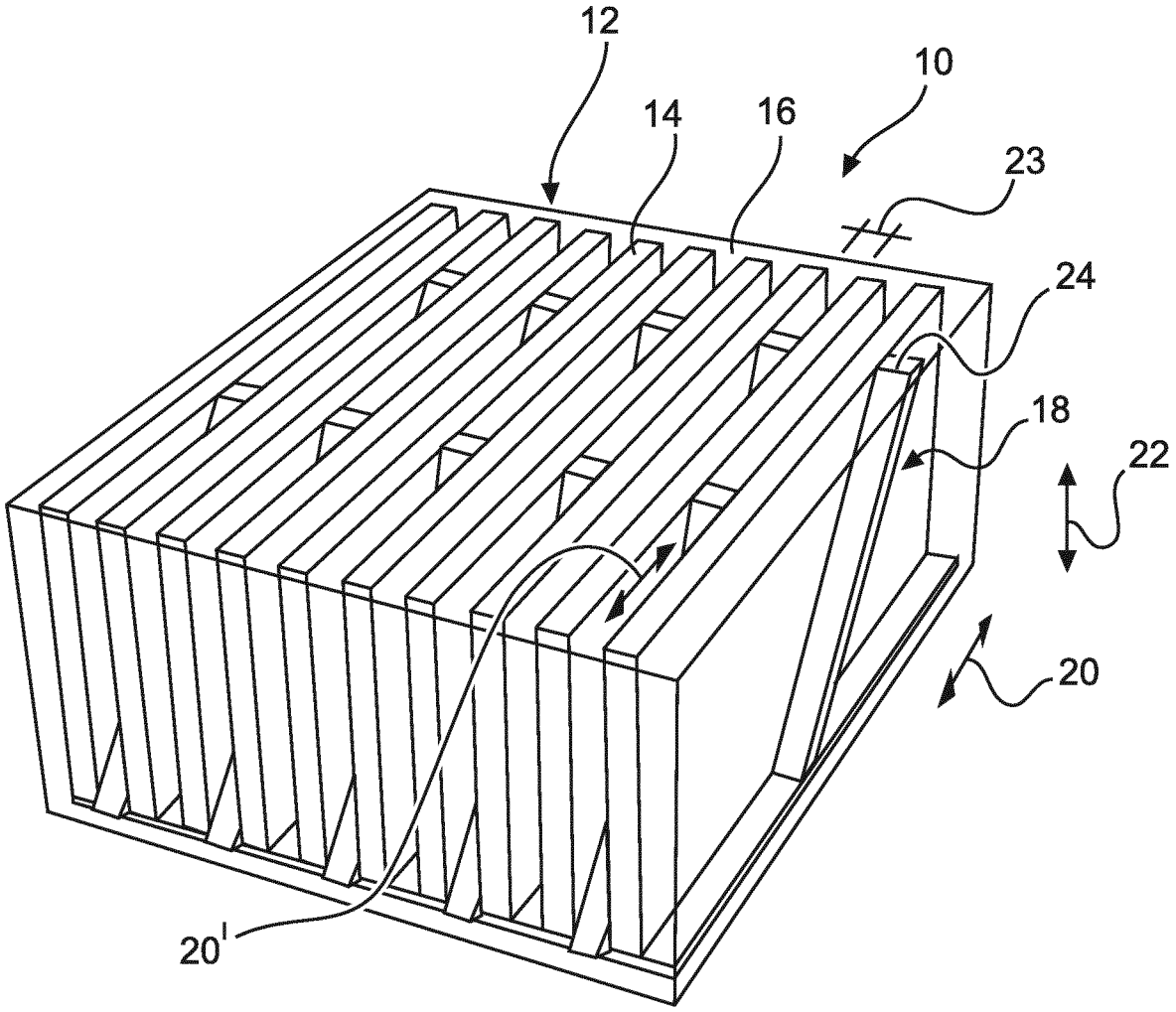
FIG. 1 shows a section of an example of a grating in a perspective view.

FIG. 1 shows a grating 10 for X-ray imaging. The grating 10 comprises a grating structure 12 with a first plurality of bar members 14 and a second plurality of gaps 16. The grating 10 further comprises a fixation structure 18 arranged between the bar members 14 in order to stabilize the bar members 14. The grating bars, i.e. the bar members 14, are extending in a length direction 20 and in a height direction 22. The bar members 14 are spaced from each other by one of the gaps 16 in a direction transverse to the height direction 22, i.e. in a spacing direction. The spacing direction is indicated with a distance arrow 23. The gaps 16 are arranged in a gap direction 20' parallel to the length direction 20. The fixation structure 18 comprises a plurality of bridging web members 24 that are provided between adjacent bar members 14. The web members 24 are longitudinal web members that are extending in the gap direction 20' and that are provided in an inclined manner in relation to the height 22 direction. The inclination is provided in the gap direction 20'.

Figure 2:
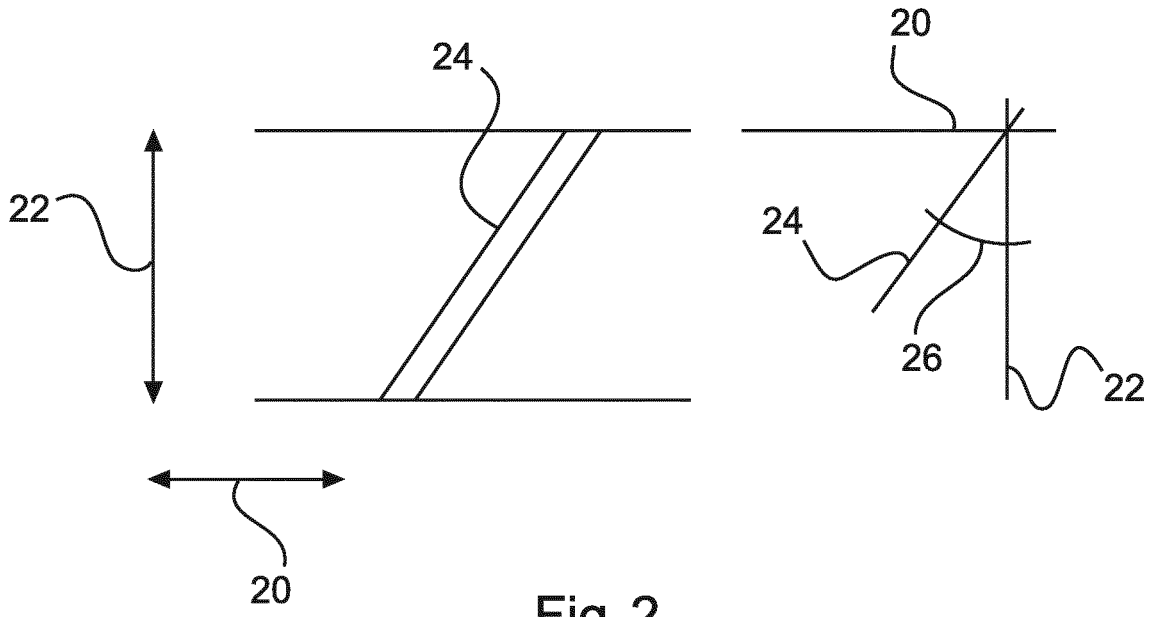
FIG. 2 illustrates a cross section along a gap of an example of a grating.

FIG. 2 indicates a cross section along a gap with an inclined web member 24 that is provided inclined spanning across the length direction 20 and the height direction 22. An inclination angle is indicated with reference numeral 26.

In an example, not further shown, the web members 24 are arranged parallel to the bar members 14 and are connected to the bar members 14 across the length on their side portions, i.e. across the length of the respective web member 24.

In an example, not further shown, the web members 24 are arranged between the adjacent bar members 14 such that the web members 24 are connecting opposing and facing portions of the bar members 14.

In other words, the web members 24 span transverse, preferably perpendicular to the gap's width direction, i.e. transverse, respectively perpendicular to the spacing direction 23. For example, the web members 24 are fixedly attached to opposite portions. In their cross-section transverse to their longitudinal direction, the web members 24 are spanning transverse to the gap direction, as mentioned. In other words, the web members 24 are connecting the bar members 14 in a direction perpendicular to the gap direction and perpendicular to the gap's depth, i.e. perpendicular to the viewing direction.

In an example, the longitudinal web members 24 are provided as linear web members.

The (first plurality of) bar members 14 and the (second plurality of) gaps 16 are forming a grating area. In an example, the grating area forms a grating plane. In another example, the grating area is provided bend on a cylindrical surface.

The web members 24 are arranged in an inclined manner in relation to a main X-ray radiation direction, i.e. in an inclined manner to the viewing direction. In case of a radiation direction perpendicular to the grating, i.e. the grating extension within the grating area, the web members 24 are arranged in an inclined manner in relation to the perpendicular of the grating area. The web members 24 are arranged with a tilt angle in relation to the grating area or grating plane.

The web members 24 stabilize the bar members 14 of the grating structure. Providing the web members 24 inclined results in a more distributed arrangement of the attenuation caused by the web members 24.

The "bar members" 14 can also be referred to as bar elements or bar segments.

The "web members" 24 can also be referred to as web elements or web segments or bridges or bridge segments.

The web members 24 provide a stabilizing web that supports the bar members 14, i.e. bars.

In an example not further shown, in an X-ray radiation viewing direction, across the height at least one first gap part is provided and at least one web segment part.

In an example, the at least first gap part is X-ray transparent and does not provide X-ray attenuation. Only the part of the gap where the web segment is arranged, X-ray radiation is attenuated.

The height direction is also referred to as a first direction or first height direction, and the length direction is referred to as second direction or second length direction.

In an example, the grating is an absorber grating and the grating structure is made such that the bar members are made from X-ray absorbing material for X-ray absorption by the bar members. The gaps are provided to be less absorbing for transmission of X-ray in the gaps. Preferably, the gap part is less X-ray absorbent than the web segment part.

For example, the web members 24 are provided in the same material as the bar members. In an example, the web members 24 are also made from X-ray absorbing material In a further example, the grating is an absorber grating and the grating structure is made such that the gaps are filled with X-ray absorbing material for X-ray absorption by the gaps. The bar members are provided to be less absorbing for transmission of X-ray in the bar members.

In another example, the web members 24 are also made to be less absorbing for transmission of X-ray.

Figure 3:
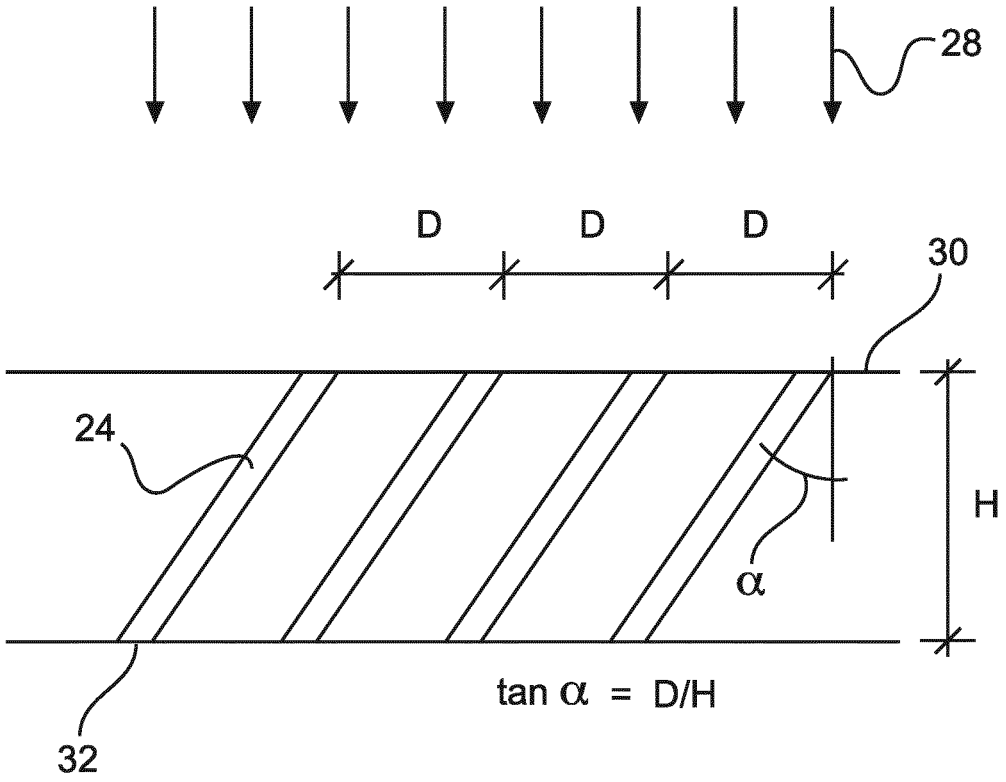
FIG. 3 shows a further example of a grating in a cross section along a gap.

In an example, as also indicated in FIG. 3 as an option, the web members 24 are arranged such that, in an X-ray radiation viewing direction 28, a continuous degree of X-ray attenuation is provided along the gaps.

For example, the web members 24 are arranged such that in X-ray viewing direction, they X-ray radiation passes one web member while passing (i.e. radiating through) the gap of the grating. In another example, the radiation passes through two or three web members 24. The number of web members 24 that are passed is the same throughout the gaps, and also the same within the gaps in the gap direction.

Providing a continuous degree of X-ray attenuation reduces the amount of artifacts in the X-ray signal provided by the detector.

Advantage of this geometry is the single illumination step. However, instead of tilting in the direction of $\alpha$ or $-\alpha$, it is also possible to make double illumination steps, for example for V-shaped and W-shaped structures as well as X-shaped structures. These can also provide a homogeneous distributed absorption of the stabilizing structure along the complete groove.

In an alternative example, the web members are provided extending perpendicular to the gap direction. A number of web members is provided across the gap's height, which web members are displaced in direction of the gap. In an example, in a viewing projection, the same degree of X-ray attenuation is provided along the gaps.

As an option, indicated in FIG. 3, the web members 24 are extending in a continuous manner from an upper edge 30 of the bar members 14 to a lower edge 32 of the bar members 14.

As a result, only one mask has to be used for the manufacturing process and only one illumination is required in the lithography step. However, it also results in that a homogeneity is created in the grating that avoids that an additional undesired fringe pattern is created. The homogeneity is provided, in particular if the web members 24 are distributed regularly.

The additional attenuation due to the web members 24 is distributed more evenly across the grating area, which reduces the impact on image quality.

As a further option, although not shown in detail, the web members 24 are arranged at least as one of the following:

i) repeatedly arranged inclined web members with the same inclination angle;

ii) inclined segments with the same inclination angle value, but with alternating inclination directions, which results in a zig-zag web pattern along the gap; and iii) repeatedly arranged inclined web segment portions that are provided in a crossing manner, which results in an X-type repeated web pattern.

In an example, the zig-zag pattern comprises portions that extend in gap's height only along a fraction of the height, but with the same inclination, which is still resulting in an even distribution of the attenuation.

FIG. 3 shows a pattern of repeated inclined web members 24. The web members 24 are arranged repeatedly in the gap direction with a distance D over a gap height H. The web members 24 have an inclination ratio in relation to the height direction R of D/H. The distance D can also be referred to as pitch. In an example, for a given grating height H and a distance D between the bridges along a trench, there is a dedicated tilt angle such that a homogeneous grating structure is achieved in transmission perpendicular to the grating area. This tilt angle $\alpha$ fulfils the relation $\tan \alpha = D/H$, as shown in the option in FIG. 3.

In an example, the grating is an absorber grating for phase contrast and/or dark-field X-ray imaging.

The fixation structure addresses the manufacturing of the gratings in phase contrast X-ray imaging, in particular of the absorption gratings G0 (as source grating following the X-ray source) and G2 (as analyzer grating in front of the detector). For example, grating structures with pitches in the order of a few μm (micrometer) to a few 10 μm, at heights in gold of more than 200 μm are provided, in order to achieve sufficient attenuation across the entire spectrum of the X-ray tube. To build such gratings, a process including lithography, electroplating, and molding can be applied. The process in known as LIGA process (German for: Lithographie, Galvanoformung, Abformung). The fixation structure stabilizes the gratings that otherwise have the tendency to be unstable due to adhesion forces in particular for high aspect ratios.

In another option, the grating is an anti-scatter grid for X-ray imaging.

Figure 4:
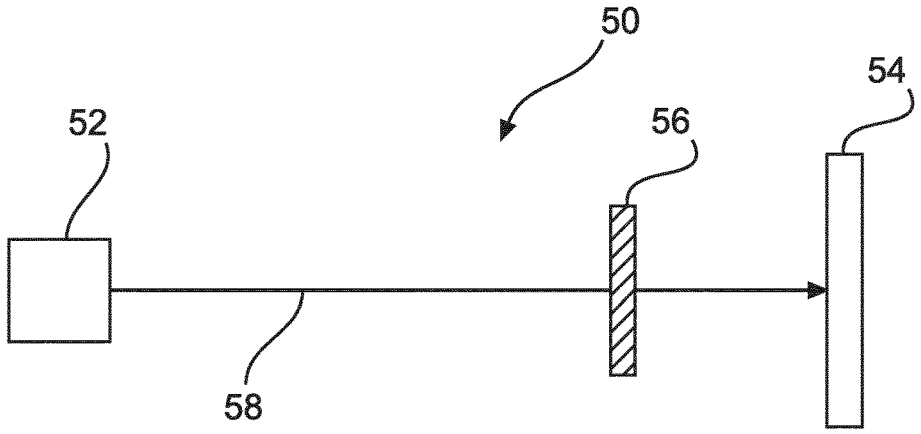
FIG. 4 schematically illustrates an example of an X-ray imaging system.

FIG. 4 schematically shows an X-ray imaging system 50 that comprises an X-ray source 52 and an X-ray detector 54. Further, a grating 56 is provided as an example of one of the above-mentioned gratings. The grating 56 is provided to be arranged in an X-ray radiation path 58 between the X-ray source 52 and the X-ray detector 54.

Figure 5:
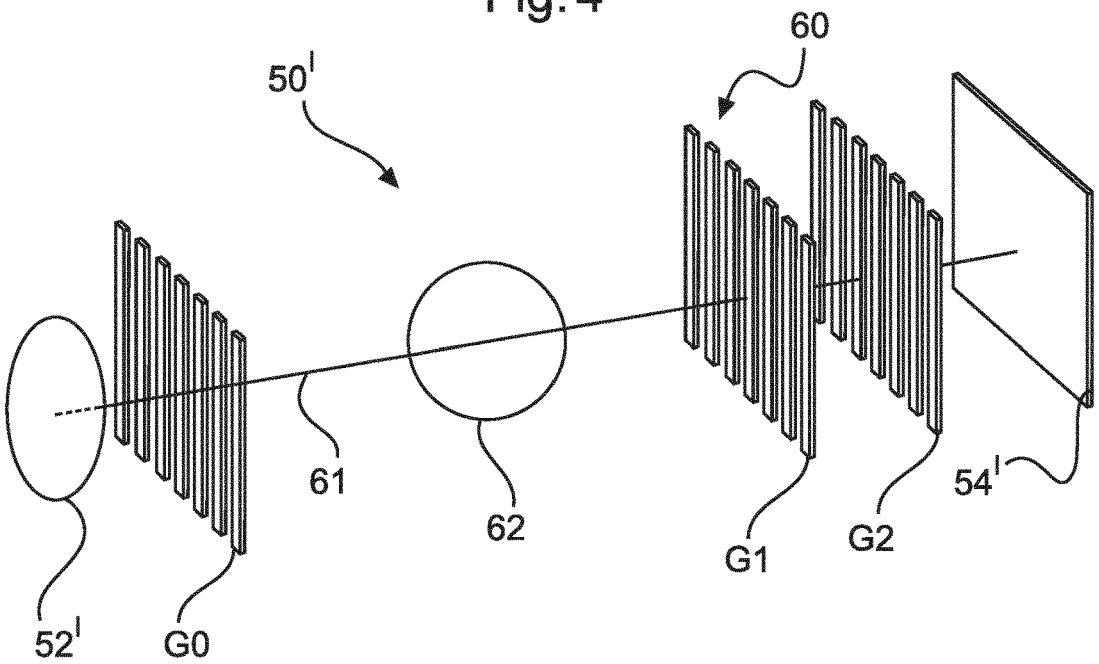
FIG. 5 illustrates a schematic setup of an imaging system for differential phase-contrast X-ray imaging.

FIG. 5 shows a system for phase contrast and/or dark-field X-ray imaging 50' as an option of the X-ray imaging system. A grating arrangement 60 for phase contrast and/or dark-field X-ray imaging is provided. At least partially coherent X-ray radiation 61 is provided to radiate an object 62. The grating arrangement 60 comprises at least a phase grating G1 and an analyzer grating G2. As an option, a source grating G0, to provide the at least partially coherent X-ray radiation, can also be provided. The analyzer grating G2 and/or the source grating G0 are provided as an absorption grating which is provided as a grating according to one of the above examples. Further aspects, such as phase stepping etc. for differential phase contrast imaging are not described in further detail.

Figure 6:
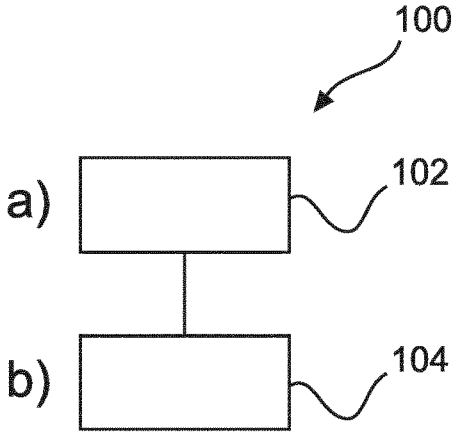
FIG. 6 indicates steps of an example of a method for manufacturing a grating.

FIG. 6 shows an example of a method 100 for manufacturing a grating for X-ray imaging. The method 100 comprises the following steps. In a first step 102, also referred to as step a), a grating structure is generated with a first plurality of bar members and a second plurality of gaps. The bar members are extending in a length direction and in a height direction, and are spaced from each other by one of the gaps in a direction transverse to the height direction. In a second step 104, a fixation structure is generated arranged between the bar members to stabilize the grating bar members. The fixation structure comprises a plurality of bridging web members that are provided between adjacent bar members. The web members 24 are longitudinal web members that are extending in the direction of the gaps and that are provided in an inclined manner in relation to the height direction.

In an example, steps a) and b) take place at the same time. In an alternative example, steps a) and b) take place after each other.

In an example, not further show, in a step a1), a mask for a radiation source is provided in order to shield radiation in a structure that is provided as a grating structure with a first plurality of bar members and a second plurality of gaps, and a fixation structure arranged between the bar members to stabilize the grating bar members. The bar members are extending in a length direction and in a height direction and are spaced from each other by one of the gaps in a direction transverse to the height direction. The fixation structure comprises a plurality of bridging web members 24 that are provided between adjacent bar members. The web members 24 are longitudinal web members that are extending in an inclined manner in relation to the height direction. In a step a2), a radiation sensitive photoresist substance is provided. In a step b'), the photoresist substance is illuminated with radiation while shielding the photoresist substance with the mask, which results in parts of the photoresist substance being fixated and other parts being non-fixated. In a step c), the non-fixated parts of the photoresist substance are removed while maintaining the fixated parts as a mold. In a step d), the grating structure is galvanically generated in the removed parts. In a step e), the fixated parts are removed.

The illumination and hardening of the photo-sensitive substance is also referred to as lithography process.

For example, the galvanic generation of the grating is provided by electroplating.

In one example, the radiation used for radiating the photoresist substance is low-energy X-ray (e.g. 5 to 10 keV) from a synchrotron radiation source.

In another example, the radiation used for radiating the photoresist substance is light from an ultraviolet light source.

Advantage of the geometry of the grating is a single illumination step (see below). However, instead of tilting in the direction of $\alpha$ or $-\alpha$, it is also possible to make double illumination steps, for example for V-shaped and W-shaped structures as well as X-shaped structures (see above). These can also provide a homogeneous distributed absorption of the stabilizing structure along the complete groove.

In an example, only one mask is provided in step a) in only one illuminating step b).

In an example, the mask is having a bridge design and the mask is tilted around an axis perpendicular to the desired grating direction. This leads to tilted bridges forming the web members 24 described above.

The maximum length of the tilted web members 24 structure is correlated with the maximum achievable depth of the lithography process. In an example, the tilting angle is selected according to the lithography limitation as well as to the capability to electroplate the gold (or other material) under the web members 24 structure within the open volume of a parallelogram.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated, and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A grating for X-ray imaging, comprising:

a grating structure including a first plurality of bar members and a second plurality of gaps; and a fixation structure arranged between the bar members to stabilize the grating bar members;

wherein the bar members are extending in a length direction and in a height direction and are spaced from each other by one of the gaps in a spacing direction transverse to the height direction and to the length direction, wherein the gaps are arranged in a gap direction parallel to the length direction;

wherein the fixation structure comprises at least one bridging web member that is provided between adjacent bar members of the plurality of bar members;

wherein one bridging web member of the at least one bridging web member is longitudinal that extends in the gap direction and that is provided in an inclined manner in relation to the height direction, wherein an inclination is provided in the gap direction; and wherein the one bridging web member of the at least one bridging web member includes an inclined portion, the inclined portion of the one bridging web member extends along an inclined direction with a constant dimension in the spacing direction and the inclined direction is perpendicular to the spacing direction and is different from the height direction and the length direction.

2. The grating according to claim 1, wherein the at least one bridging web member and the bar members are made from the same material; and wherein the at least one bridging web member and the bar members are made as a one-piece structure.

3. The grating according to claim 1, wherein the bar members and the at least one bridging web member are made from structure material, and an X-ray absorbing material is arranged in the gaps; and wherein the structural material is less X-ray absorbing than the X-ray absorption material.

4. The grating according to claim 3, wherein the grating is an absorber grating, and the grating structure is made such that the gaps are filled with the X-ray absorbing material for X-ray absorption by the gaps; and wherein the bar members are provided to be less X-ray absorbing for X-ray radiation transmission in the bar members.

5. The grating according to claim 1, wherein the grating is an absorber grating, and the grating structure is made such that the bar members are made from X-ray absorbing material for X-ray absorption by the bar members, and the gaps are provided to be less X-ray absorbing for X-ray radiation transmission in the gaps.

6. The grating according to claim 1, wherein one bridging web member of the at least one bridging web member is arranged between the adjacent bar members such that the one bridging web member of the at least one bridging web member connects opposing portions of the bar members; and/or wherein the at least one bridging web member includes a plurality of bridging web members, and in a non-assembled state the plurality of bridging web members are arranged parallel to each other.

7. The grating according to claim 1, wherein, in an X-ray radiation viewing direction, across the height at least one first gap part and at least one web segment part are provided.

8. The grating according to claim 1, wherein one bridging web member of the at least one bridging web member is arranged such that, in an X-ray radiation viewing direction, a continuous degree of X-ray attenuation is provided along the gaps.

9. The grating according to claim 1, wherein one bridging web member of the at least one bridging web member extends in a continuous manner from an upper edge of the bar members to a lower edge of the bar members; and/or wherein the at least one bridging web member includes a plurality of bridging web members the plurality of bridging web members are arranged repeatedly in gap direction with a distance D over a gap height H; and wherein the plurality of bridging web members have an inclination ratio in relation to the height direction R of D/H.

10. The grating according to claim 1, wherein the at least one bridging web member includes a plurality of bridging web members, and the plurality of bridging web members are arranged at least as one of the following:

as repeatedly arranged inclined web members with the same inclination angle;

as inclined segments with the same inclination angle value, but with alternating inclination directions, which results in a zig-zag web pattern along the gap; and as repeatedly arranged inclined web segment portions that are provided in a crossing manner, which results in an X-type repeated web pattern.

11. The grating according to claim 1, wherein the grating is at least one of:

an absorber grating for phase contrast and/or dark-field X-ray imaging; and an anti-scatter grid for X-ray imaging.

12. An X-ray imaging system, comprising:

an X-ray source, an X-ray detector; and a grating according to claim 1 to be arranged in an X-ray radiation path between the X-ray source and the X-ray detector.

13. The X-ray imaging system according to claim 12, wherein the X-ray source provides the X-ray radiation towards the X-ray detector in an X-ray viewing direction; and wherein one bridging web member of the at least one bridging web member is provided in an inclined manner in relation to the X-ray viewing direction.

14. The X-ray imaging system according to claim 12, wherein a grating arrangement for phase contrast and/or dark-field X-ray imaging is provided;

wherein at least partially coherent X-ray radiation is provided to radiate an object;

wherein the grating arrangement comprises at least a phase grating and an analyzer grating; and wherein the grating is provided as an absorption grating forming:

the analyzer grating; and/or a source grating to provide the at least partially coherent X-ray radiation.

15. A method for manufacturing a grating for X-ray imaging, comprising:

generating a grating structure including a first plurality of bar members and a second plurality of gaps, wherein the bar members are extending in a length direction and in a height direction and are spaced from each other by one of the gaps in a spacing direction transverse to the height direction and to the length direction; and generating a fixation structure arranged between the bar members to stabilize the grating bar members, wherein the fixation structure comprises at least one bridging web member that is provided between adjacent bar members of the plurality of bar members, and wherein one bridging web member of the at least one bridging web member is longitudinal that extends in the direction of the gaps and that is provided in an inclined manner in relation to the height direction, wherein the one bridging web member of the at least one bridging web member includes an inclined portion, the inclined portion of the one bridging web member extends along an inclined direction with a constant dimension in the spacing direction, and the inclined direction is perpendicular to the spacing direction and is different from the height direction and the length direction.

* * * * *